US007697872B2

(12) United States Patent
Kim et al.

(10) Patent No.: US 7,697,872 B2
(45) Date of Patent: Apr. 13, 2010

(54) DEVELOPING CARTRIDGE INCLUDING AN IMPROVED DEVELOPER REGULATING MEMBER AND IMAGE FORMING APPARATUS HAVING THE SAME

(75) Inventors: Hyung-jin Kim, Seoul (KR); Su-in Lee, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 589 days.

(21) Appl. No.: 11/701,443

(22) Filed: Feb. 2, 2007

(65) Prior Publication Data

US 2007/0201908 A1 Aug. 30, 2007

(30) Foreign Application Priority Data

Feb. 3, 2006 (KR) ..... 10-2006-0010815

(51) Int. Cl.
*G03G 15/08* (2006.01)
*G03G 15/09* (2006.01)

(52) U.S. Cl. ..... 399/274; 399/284

(58) Field of Classification Search ..... 399/274, 399/284

See application file for complete search history.

(56) References Cited

U.S. PATENT DOCUMENTS 6,064,463 A * 5/2000 Yamada et al. ..... 399/284
6,603,944 B2 * 8/2003 Tatsumi ..... 399/284
6,823,164 B2 * 11/2004 Tatsumi ..... 399/284
7,082,280 B2 * 7/2006 Kim ..... 399/274

FOREIGN PATENT DOCUMENTS

| | | |
|---|---|---|
| JP | 2001-281985 | 10/2001 |
| JP | 2003-215911 | 7/2003 |
| KR | 2004-90204 | 10/2004 |
| KR | 2005-21780 | 3/2005 |

* cited by examiner

*Primary Examiner*—William J Royer
(74) *Attorney, Agent, or Firm*—Staas & Halsey LLP

(57) ABSTRACT

An image forming apparatus includes: a main body, a photosensitive body spreading developer on a printing paper, a developing roller supplying the photosensitive body with the developer, a developer regulating member regulating the amount of the developer supplied for the photosensitive body by the developing roller, the developer regulating member comprising a supporting member coupled to the main body and an elastic metal board having a bent part extended from the supporting member and contacting with the photosensitive body, and a free length of the elastic metal board being adjusted shorter as a draw rate of the elastic metal board material increases. Accordingly, a developing cartridge and an image forming apparatus has a free length of a developer regulating member that is adjustable to keep the density of developer uniform according to material characteristics of the developer regulating member.

25 Claims, 7 Drawing Sheets

DEVELOPING CARTRIDGE INCLUDING AN IMPROVED DEVELOPER REGULATING MEMBER AND IMAGE FORMING APPARATUS HAVING THE SAME

CROSS-REFERENCE TO RELATED APPLICATION

This application claims the benefit of Korean Application No. 2006-10815, filed on Feb. 3, 2006 in the Korean Intellectual Property Office, the disclosure of which is incorporated herein by reference.

BACKGROUND OF THE INVENTION

1. Field of the Invention

Aspects of the present invention relate to a developing cartridge and an image forming apparatus having the same, and more particularly, to a developing cartridge and an image forming apparatus having an improved configuration of a developer regulating member.

2. Description of the Related Art

In general, image forming apparatuses are connected to a host apparatus and print images of data stored in the host apparatus on a printable medium (such as printing paper, transparencies, and the like) according to an output signal from the host apparatus. One of such image forming apparatuses is an electrophotography type, which is provided with a photosensitive body on which an electrostatic latent image is formed, a developing unit to develop a developer on the photosensitive body, and a transferring unit to transfer the developed developer on the photosensitive body to the printable medium. The electrophotographic image forming apparatus may be a printer, a photocopier, and/or a multi-functional device.

FIG. 1 is a schematic view illustrating a configuration of a related art electrophotographic image forming apparatus 100. As shown in FIG. 1, the electrophotographic image forming apparatus 100 comprises a feeding part 110 to store printable media, an image forming part 140 to form an image on the printable media supplied from the feeding part 110, a fixing part 150 to fix a developer on a surface of the printable media by heat and pressure, and a discharging part 160 to discharge the printable media on which an image is formed.

The image forming part 140 comprises a light scanning unit 130 which receives image information of an image data from a light signal to form an electrostatic latent image on the surface of a photosensitive body 122, and a developing cartridge 120 which spreads developer on the electrostatic latent image on the photosensitive body 122 formed by the light scanning unit 130, and which transfers the developer to contact the printable media to form the image on the printable media.

The developing cartridge 120 is detachably provided in a main body 170 of the image forming apparatus 100. Accordingly, the developing cartridge 120 is a consumption good capable of being replaced when the developer stored therein runs out. The developing cartridge 120 comprises an electrifying roller 121 to electrify the photosensitive body 122 to a predetermined potential, the photosensitive body 122 to form an electrostatic latent image on the surface thereof by the exposure of the light scanning unit 130 after being electrified to the predetermined potential through the electrifying roller 121, a developing roller 123 to spread the developer on the electrostatic latent image formed on the surface of the photosensitive body 122 that contacts the photosensitive body 122, a supplying roller 124 to supply the developer to the developing roller 123, a developer regulating member 125 to regulate the amount of the developer supplied to the developing roller 123, and a developer storing part 126 to store the developer.

In the related art developing cartridge 120 with the above described configuration, the developer regulating member 125 is able to maintain a regular (or consistent) thickness of a developer layer while the developing roller 123 rotates and the developer is supplied from the supplying roller 124. The developing roller 123 contacts and rotates in the same direction with the photosensitive body 122 to maintain a regular distance therebetween. Then, the developer on the surface of the developing roller 123 is attached to the electrostatic latent image of the photosensitive body 122 by a potential difference between the photosensitive body 122 and the developing roller 123. Accordingly, a visible image is formed on the photosensitive body 122.

Then, the developer on the photosensitive body 122 is transferred to the printable medium by a transferring roller 141 to form an image on the printable medium.

Here, the developer regulating member 125 regulates the density of the developer transferred from the developing roller 123 to the photosensitive body 122 according to the length (a free length) of the developer regulating member 125 from a casing 128 to a free end part that contacts with the developing roller 123.

However, such a related art developer regulating member 125 is fixedly coupled to the casing 128 and has the same free length regardless of the different product models of the electrophotographic image forming apparatus. Accordingly, it is difficult to keep the density of the developer output on the printable medium uniform because a tangential pressure applied to the developer is non-uniform as the developer regulating member 125 is made of material having non-uniform characteristics.

Also, when a user is not satisfied with the developer density, there is no way to physically regulate a position of the developer regulating member 125 to adjust the density of the developer. Accordingly, a user is inconvenienced by having to regulate the density of the developer only by selecting the density through an image forming apparatus driver.

SUMMARY OF THE INVENTION

According to aspects of the present invention, a developing cartridge and an image forming apparatus having the same in which a free length of a developer regulating member is provided to have a different length to keep the density of developer uniform according to material characteristics of the developer regulating member.

Aspects of the present invention include an image forming apparatus including: a main body of a toner cartridge, a photosensitive body spreading developer on a medium, a developing roller supplying the photosensitive body with the developer, a developer regulating member regulating the amount of the developer supplied for the photosensitive body by the developing roller, the developer regulating member comprising a supporting member coupled to the main body and an elastic metal board having a bent part extended from the supporting member and contacting the photosensitive body, and a free length of the elastic metal board that was provided shorter as a draw rate of the elastic metal board material was increased.

According to another aspect of the present invention, a deflection angle made by deflection of the free end part with respect to the supporting member is larger than a tangential angle between a tangent of the elastic metal board in contact with the developing roller and the supporting member.

According to another aspect of the present invention, the elastic metal board comprises one of beryllium bronze, stainless steel, and phosphor bronze.

According to another aspect of the present invention, the developing roller comprises a non-magnetic rubber having a hardness value in a range of 50 to 80 according to a Japanese Industrial Standard (JIS) A scale.

Aspects of the present invention include a developing cartridge including: a main body, a photosensitive body spreading developer on a printing paper, a developing roller supplying the photosensitive body with the developer, and a developer regulating member uniformly regulating the amount of the developer supplied for the photosensitive body by the developing roller, the developer regulating member comprising a supporting member coupled to the main body and an elastic metal board having a bent part extended from the supporting member and contacting the photosensitive body, and a free length of the elastic metal board that was provided shorter as a draw rate of the elastic metal board material was increased.

According to another aspect of the present invention, a deflection angle made by deflection of the free end part with respect to the supporting member is larger than a tangential angle between a tangent of the elastic metal board in contact with the developing roller and the supporting member.

According to another aspect of the present invention, the elastic metal board comprises one of beryllium bronze, stainless steel, and phosphor bronze.

According to another aspect of the present invention, the developing roller comprises a non-magnetic rubber having a hardness value in a range of 50 to 80 (Japanese Industrial Standard (JIS) A scale).

According to an aspect of the present invention, a developing cartridge includes: a developing roller; and a developing regulating member comprising a support member and a thin panel, the support member being fixed to the developing cartridge and the thin panel having a free length between a first end and a second end thereof, wherein the second end is attached to the support member and the first end tangentially touches the developing roller, and a density of a developer adhering to the developing roller is controlled by adjusting a draw rate and the corresponding free length of the thin panel.

According to an aspect of the present invention, a developing cartridge includes: a developing roller; and a developing regulating member comprising a support member and an elastic metal board that extends from the support member, wherein the length of the extending part of the elastic metal board has been adjusted according to one or more material characteristics of the elastic metal board to adjust the density of the developer adhering to the developing roller.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompany drawings of which.

DETAILED DESCRIPTION OF THE EMBODIMENTS

Figure 1:
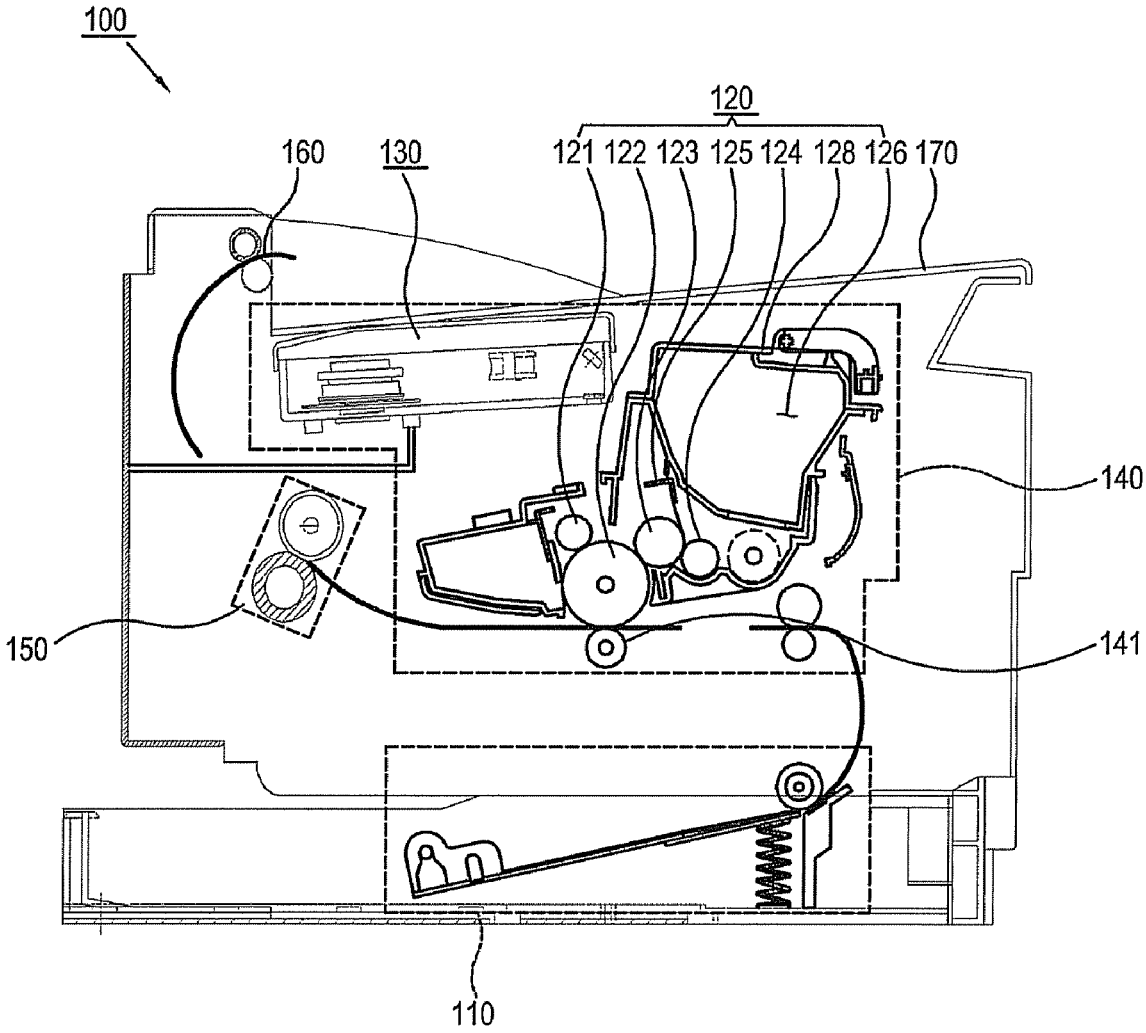
FIG. 1 (RELATED ART)
FIG. 1 is a schematic view illustrating a configuration of a related art image forming apparatus.

Reference will now be made in detail to aspects of the present invention, examples of which are illustrated in the accompanying drawings, wherein like reference numerals refer to like elements throughout. The aspects are described below so as to explain the present invention by referring to the figures.

Figure 2:
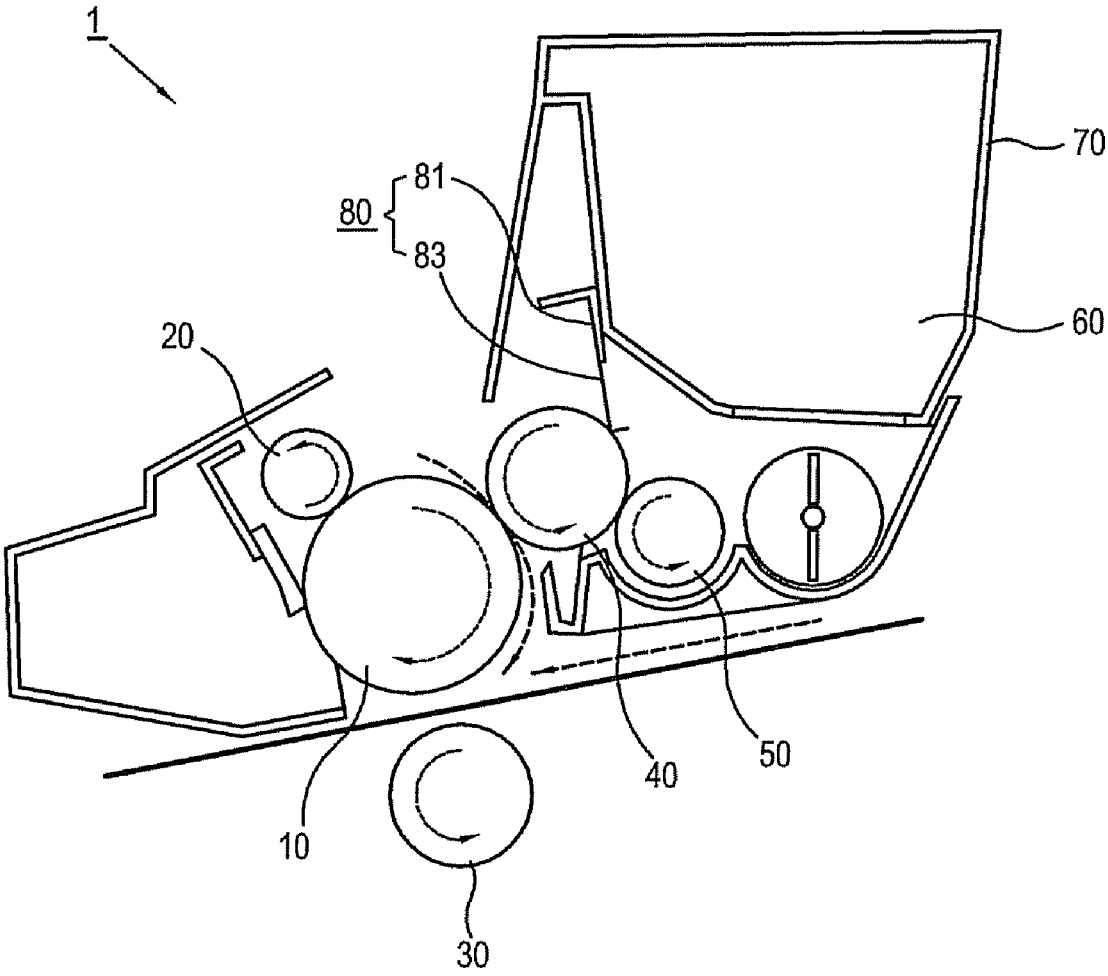
FIG. 2 is a schematic view illustrating a configuration of a developing cartridge according to an aspect of the present invention.
Figure 3:
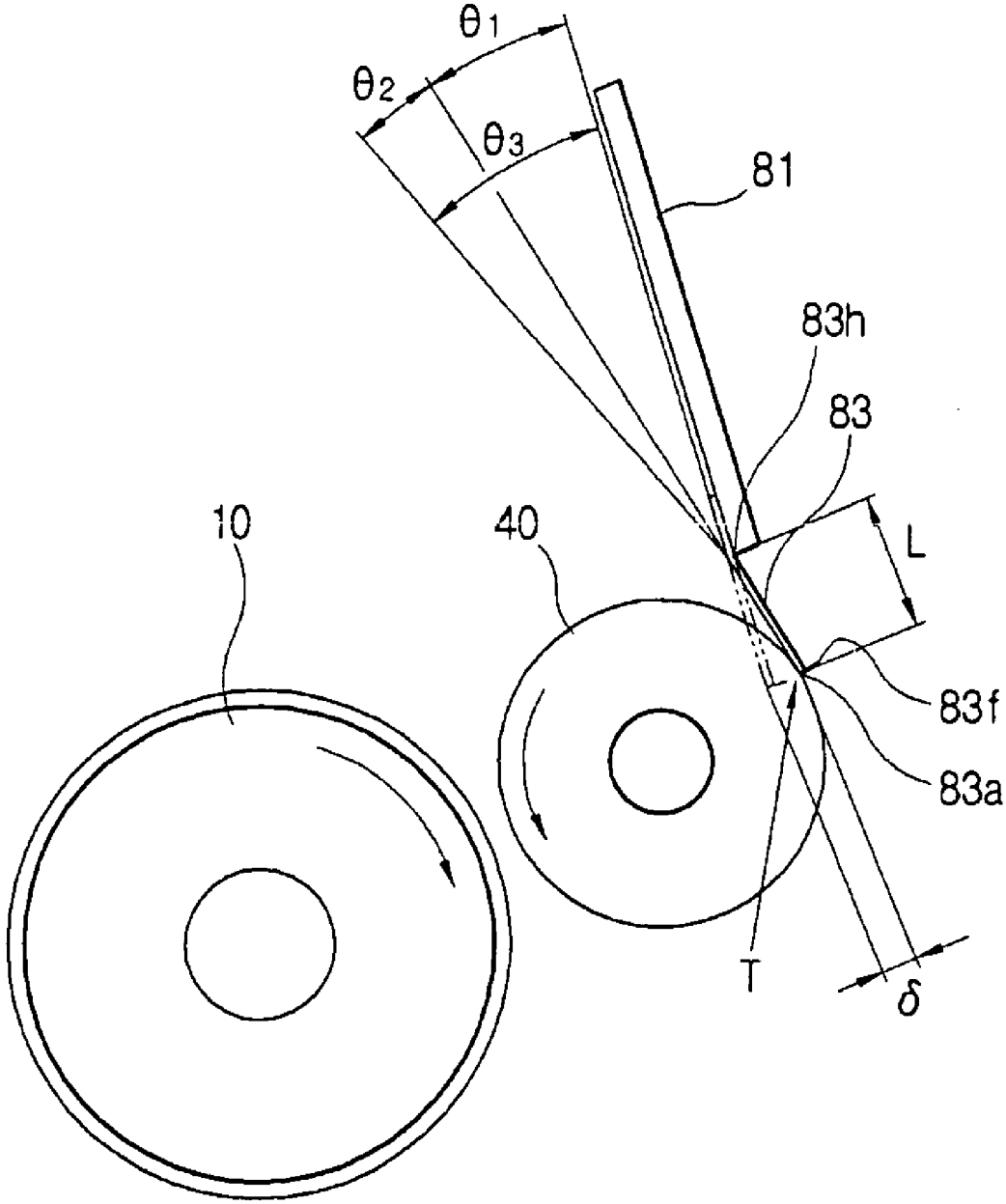
FIG. 3 is an enlarged view illustrating a configuration of a developer regulating member of FIG. 2.

FIG. 2 is a schematic view illustrating a configuration of a developing cartridge 1 according to aspects of the present invention, and FIG. 3 is an enlarged view illustrating a configuration of a developer regulating member 80 of FIG. 2.

As shown in FIGS. 2 and 3, the developing cartridge 1 according to aspects of the present invention comprises a photosensitive body 10 to spread a developer on a printable medium, such as printing paper, transparencies, and the like, an electrifying roller 20 to electrify (or charge) the photosensitive body 10 to a predetermined electric potential, a transferring roller 30 to transfer the developer on the photosensitive body 10 on the printable medium, a developing roller 40 to spread the developer on the photosensitive body 10, a supplying roller 50 to supply the developer for the developing roller 40, a developer storing part 60 to store the developer, the developer regulating member 80 to regulate the developer amount on the developing roller 40, and a casing 70 to accommodate these components.

To form an electrostatic latent image corresponding to an image data, the surface of the photosensitive body 10 is electrified (or charged) to a predetermined potential by the electrifying roller 20 and light is scanned on the surface thereof by a light scanning apparatus (see in FIG. 1). As the photosensitive body 10 has the same configuration as the related art photosensitive body 122, a detailed description thereof will be omitted.

The electrifying roller 20 is supplied with power from a light source supplying part (not shown) to electrify the photosensitive body 10 to a predetermined potential. The electrifying roller 20 is made of a conductive rubber having a predetermined hardness. The transferring roller 30 detects resistance of the printable medium and supplies a transferring voltage corresponding thereto to transfer the developer applied to the surface of the photosensitive body 10 on to the printable medium.

The developing roller 40 is supplied with the developer from the supplying roller 50 and spreads the supplied developer on the electrostatic latent image of the photosensitive body 10. The developing roller 40 is drum shaped and is rotatably provided to transfer the developer to the photosensitive body 10. The developing roller 40 is desirably made of a conductive rubber without magnetism, and desirably provided to have a hardness of 50 to 80 according to the Japanese Industrial Standard (JIS) A SCALE. In various aspects, it is desirable to use a single-ingredient non-magnetic toner for the developer, but other developing toner may be used, including multiple-ingredient toners.

The supplying roller 50 supplies the developer stored in the developer storing part 60 to the developing roller 40. An agitator (not shown) is provided in the developer storing part 60 to stir the developer while the agitator rotates. The stirred developer is supplied to the supplying roller 50.

The casing 70 makes up an outer exterior of the developing cartridge 1 and accommodates (or contains) the above described components. The casing 70 may have a variety of shapes according to the desired arrangement, the size of the components, and an available space within an image forming device to fit the casing 70.

As shown in FIG. 3, the developer regulating member 80 comprises a supporting member 81 coupled to the casing 70 and an elastic metal board 83 having a bent part 83*a* which is provided at an end position of a predetermined free length (L) of the elastic metal board 83. The bent part 83*a* contacts the surface of the developing roller 40 at a tangent line long a side-to-side width thereof. The bent part 83*a* makes an angle of almost 90° from the elastic metal board 83, which resembles the letter "L" from a side view thereof. The elastic metal board 83 is elastically deformable and applies a regular (or a constant or consistent) tangential line pressure to the developing roller 40. In other words, the elastic metal board 83 contacts and applies a line pressure to the developing roller 40 along the entire width of the elastic metal board 83 along the tangent line. In a non-limiting aspect, the free length (L) is the length of the elastic metal board 83 from the bent part 83*a* to the supporting member 81.

The elastic metal board 83 is desirably made of a metal panel whose thickness is within a range of 0.05 mm to 0.1 mm. Examples of the elastic metal board 83 include a stainless board, a phosphor bronze board, or a beryllium bronze board. The elastic metal board 83 is coupled to the supporting member 81 by a well-known method like laser welding and the like. In various aspects, the phosphor bronze is an alloy of phosphor and one or more elements, such as tin, and the beryllium bronze is an alloy of beryllium with one or more elements, such as copper. Also, in various aspects, the elastic metal board 83 may be coupled to the supporting member 81 by any coupling or attaching methods, including adhesives, fasteners, and/or the like. Also, although described in terms of a metal, the elastic metal board 83, in other aspects, may be a non-metal, such as plastic, a polymer, a composite, and/or the like.

In this aspect, the metal material used for the elastic metal board 83 has proper (or various) characteristics. These characteristics include stress, density, draw rate, thermal expansion rate, elastic coefficient, surface roughness, hardness, strength, tensile strength, and/or the like.

In the developer regulating member 80 according to aspects of the present invention, the elastic metal board 83 is coupled to the supporting member 81 and made to have a different free length (L) according to the characteristics of the above described metal material. Also, as to the developer regulating member 80, as the draw rate of the metal material constituting the elastic metal board 83 increases, the elastic metal board 83 coupled to the supporting member 81 is made to have a shorter free length (L).

In various aspects, the draw rate represents a ratio that a material is extended lengthwise by applying a predetermined force thereto. In various aspects, the material having a large draw rate extends more easily than the material having a small draw rate. In other words, the draw rate is the rate of which the length of a material is elongated relative to the material's given length. In this aspect, the draw rate is the relative lengthening of the length with respect to the original or the final desired length. Thus, a higher draw rate refers to a greater lengthening as compared to that of a lower draw rate, given the same original length or a final desired length. In various aspects, an elastic metal material that is lengthened more to reach a desired final length has a higher draw rate than an elastic metal material that is lengthened less to reach the same desired final length. In various aspects, as the draw rate of an elastic metal material increases, the hardness and/or the tensile strength of the elastic metal material increase.

In the bent part 83*a* of the elastic metal board 83 of a metal having a large draw rate, a texture of the metal material on the surface thereof is relatively shallow compared with the elastic metal board 83 having a metal of a smaller draw rate. Such texture is deeper and more numerous in metals with a smaller draw rate. As the texture of the metal material generated by such a bending causes more tangential line pressure at a line in contact with developer on the surface of the developing roller 40, the amount of regulated developer increases. In various aspects, the draw rate corresponds to the surface roughness of the elastic metal material.

Figure 4:
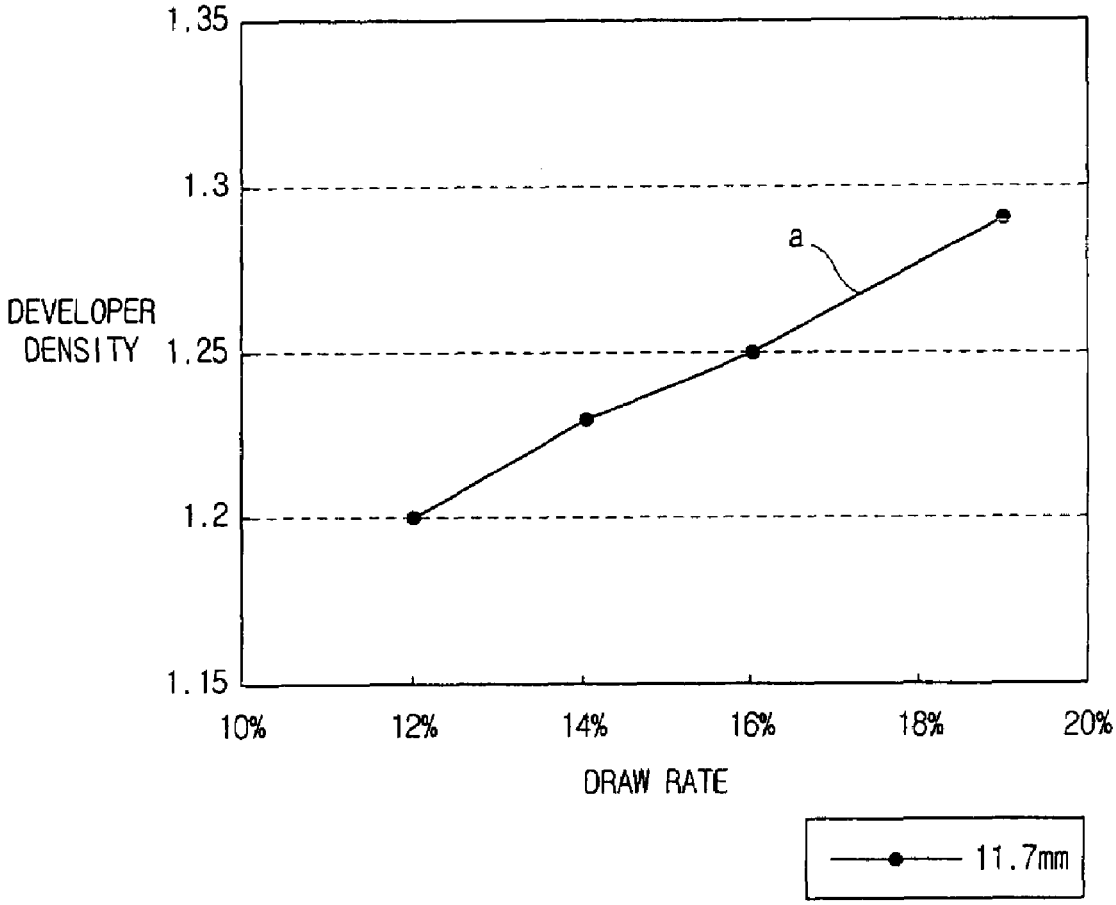
FIGS. 4 and 5 are graphs illustrating relationships between draw rates of elastic metal boards and developer densities of an outputted printable media according to aspects of the present invention.

FIG. 4 is a graph illustrating a relationship between elastic metal boards having different draw rates relative to the developer density of a printable medium according to an aspect of the present invention. In a non-limiting example, the elastic metal boards 83 having different draw rates are made of beryllium bronze having the same elasticity coefficient and have the same free length of 11.7 mm, respectively.

As shown in FIG. 4, as the draw rate of the elastic metal boards 'a' each having a free length of 11.7 mm increases, the density of the developer on the outputted paper also increases.

Figure 5:
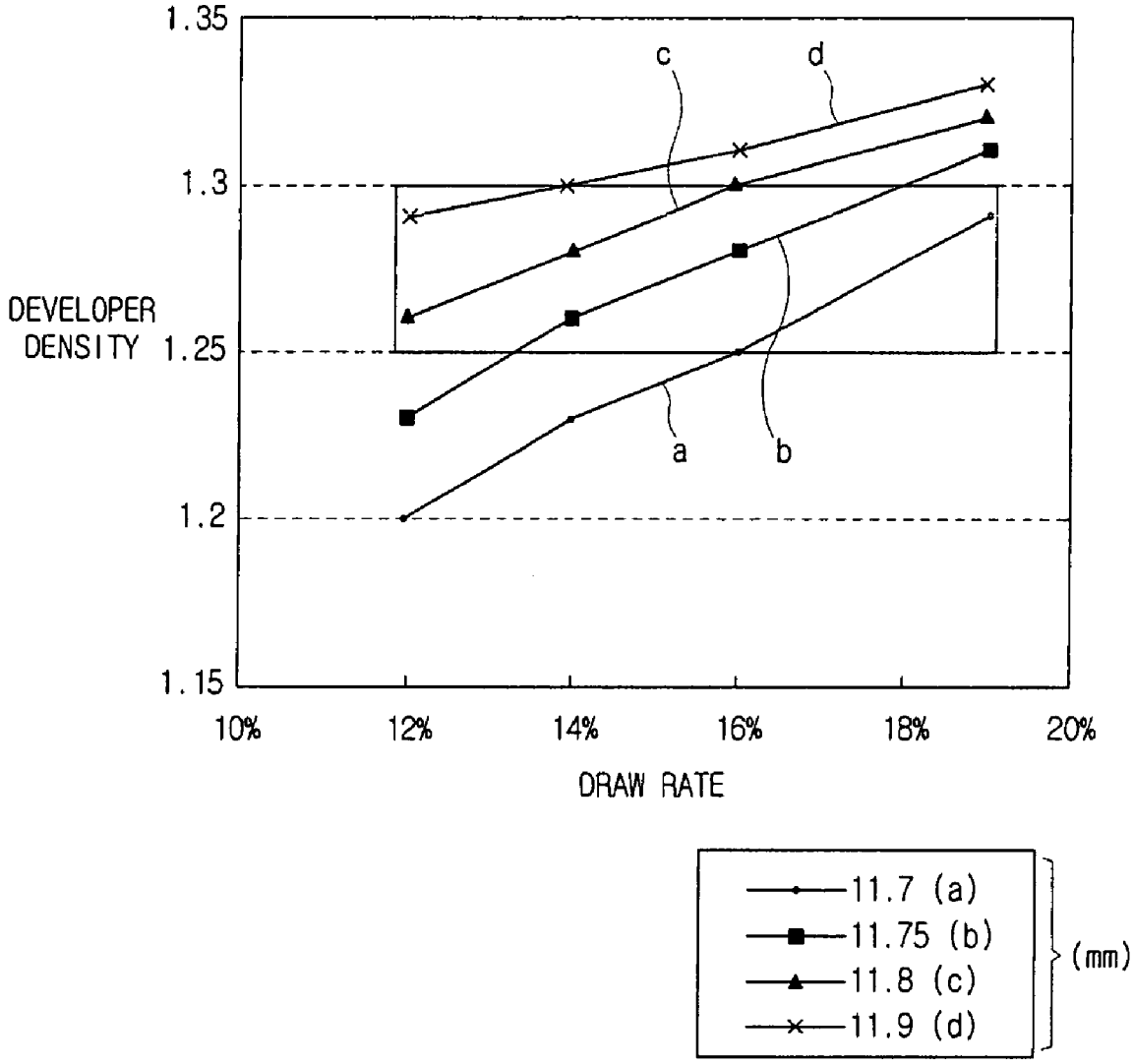
Figure 6:
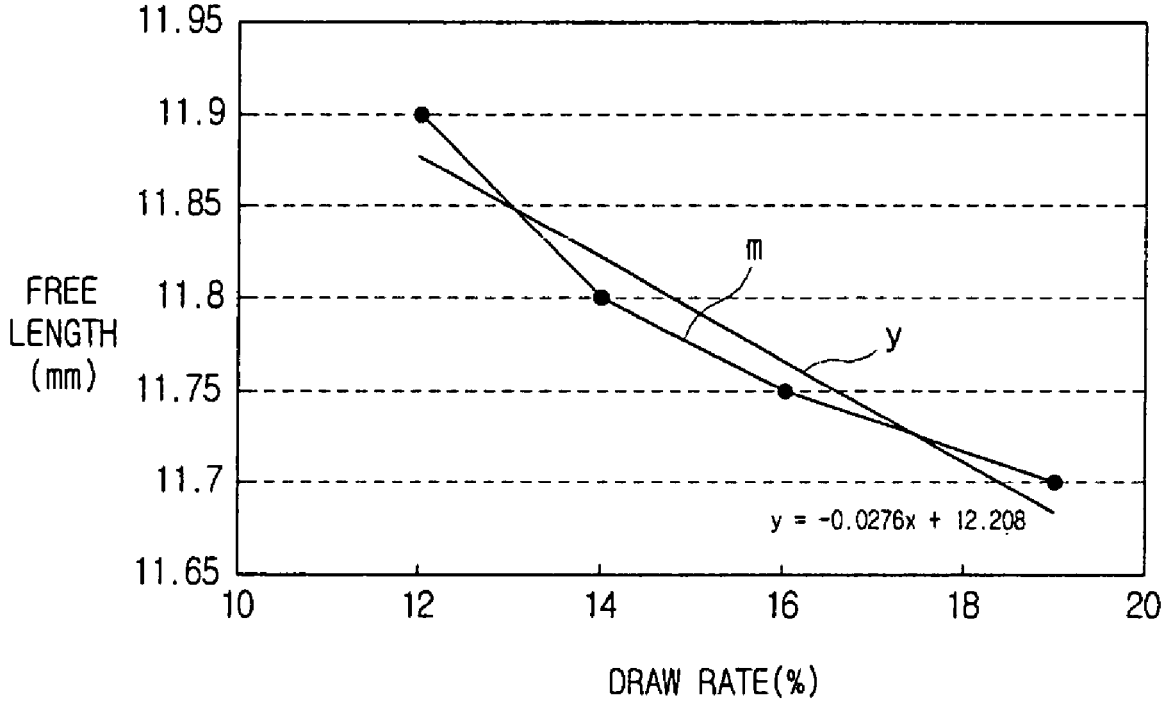
FIG. 6 is a graph illustrating a relationship between a free length of an elastic metal board and a draw rate of the elastic metal board according to an aspect of the present invention.

FIG. 5 is a graph illustrating elastic metal boards a, b, c, and d, having different free lengths relative to the developer density of the printable medium according to an aspect of the present invention. As shown, when the free lengths of the elastic metal boards respectively represent 11.7 mm (a), 11.75 mm (b), 11.0 mm (c), and 11.9 mm (d), and as the draw rate increases, the density of the developer on the outputted printing paper also increases, which is consistent with FIG. 4. Accordingly, a desired density of the developer may be set (or determined) by controlling one or both of the draw rate and the free length (L) of an elastic metal board. As an example, the desired density of the developer may be set (or determined) by using the draw rate and the free length (L) relationship on the basis of the result of the graphs of FIGS. 4 and 5. For example, when a desired developer density is 1.25 to 1.3, the elastic metal board 83 made of beryllium bronze having a draw rate of 13.5 to 14.5% may be desirably coupled to the supporting member 81 with a free length (L) of 11.75 to 11.9. In FIGS. 4, 5, and 6, the unit for the density may be $mg/cm^2$.

FIG. 6 is a graph illustrating a relationship between a free length (L) of the elastic metal board 83 and a draw rate thereof, when a desired developer density is 1.25 to 1.3. The graph 'y' illustrates a relationship therebetween on the basis of the experiment result 'm', and a formula corresponding to the graph may be obtained or generated. One such formula may be a best fit line of the experimental result m of FIG. 6, which may be $y=-0.0276x+12.208$, where x is a draw rate in percentage (%). By this or other formula, a desired free length (L) corresponding to the draw rate may be designed (or obtained or generated).

Alternatively, in the various aspects of the present invention, the length of free length (L) is set by a draw rate characteristic of the elastic metal board 83 but may also be designed by other characteristics of the elastic metal board 83. In various aspects, the characteristics may be elasticity, hardness, strength, tensile strength, and/or the like.

As shown in FIG. 3, the developer regulating member 80 according to aspects of the present invention elastically deforms (or deflects) as much as a deformation (or deflection) δ due to the developing roller 40, and a tangential line pressure f is generated at the same time. The tangential line pressure f may be applied by a bend in the bent part 83*a*, or by some other part. The pressure f may be represented by the following formula according to a bending formula of a cantilever.

$$f = \frac{\delta E t^2}{4L^3} \quad \text{(Equation 1)}$$

Here, the 'f' indicates the tangential line pressure in the gram-force per centimeter unit (gf/cm), 'E' indicates an elastic coefficient of the elastic metal board 83, 't' indicates the thickness of the elastic metal board 83, and 'L' indicates the length of the elastic metal board 83 that elastically deformed, which refers to the length from one end part 83*h* of the elastic metal board 83 (where the elastic metal board 83 meets the supporting member 81) to the free end part 83*f* of the elastic metal board 83 (or, the free length), and the δ indicates the deformation (or the deflection) between the original position of the free end part 83*f* without the developing roller 40 and the final deflected position of the bent part 83*a* (i.e., the deflected amount of the free end 83*f*).

The elastic metal board 83 (or a free end part 83*f* thereof) supported on the supporting member 81 is provided to have a predetermined tangential angle θ1 relative to the supporting member 81. The tangential angle θ1, as illustrated in FIG. 3, indicates an angle between a tangent (T) of the free end part 83*f* of the elastic metal board 83 in contact with the developing roller 40 (at or near where the bent portion 83*a* is located) and a non-deformed part of the elastic metal board 83 used to attach the elastic metal board 83 to the support member 81. The non-deformed part of the elastic metal board 83 is parallel to the support member 81.

When the free end part 83*f* of the elastic metal board 83 is elastically deformed as much as a deformation δ by a tangential pressure 'f', 'L' indicates the length of the elastic metal board 83 that is elastically deformed, the deformation angle θ3 of the free end part 83*f* of the elastic metal board 83 with respect to non-deformed part of the elastic metal board 83 (that is, to the supporting member 81) may be represented as the following formula according to the slope equation of a cantilever.

$$\theta 3 = \frac{3\delta}{2L} \times \frac{180}{\pi} \quad \text{(Equation 2)}$$

Based on the above two angles, a regulation angle θ2 regulating the thickness of the developer layer on the developing roller 40 according to an aspect of the present invention may be defined as follows.

$$\theta 2 = \theta 1 - \theta 3 \quad \text{(Equation 3)}$$

Here, the developer regulating member 80 according to an aspect of the present invention is provided so that the regulation angle θ2 can have a negative value. In other words the deformation angle θ3 of the free end part can be bigger than the tangential angle θ1. As shown in FIG. 3, it is understood that θ2 can also have a positive value, in which case, θ1 is greater than or equal to θ3.

Figure 7:
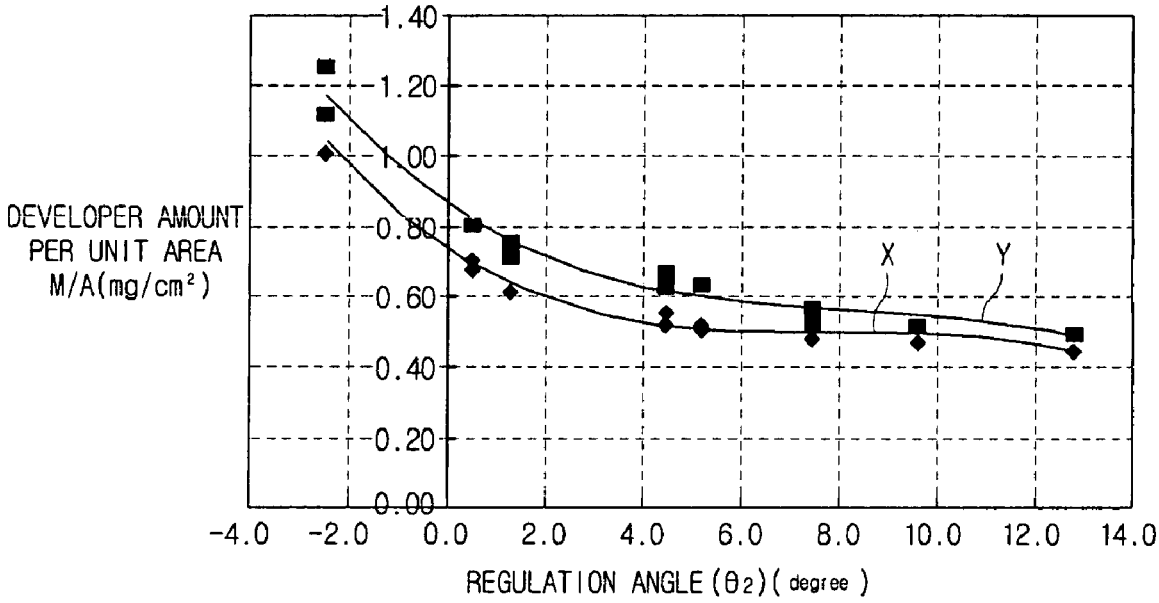
FIG. 7 is a graph illustrating a relationship between a regulation angle of a developer regulating member and the developer amount on a developing roller according to an aspect of the present invention.

FIG. 7 is a graph illustrating a relationship between a regulation angle θ2 of a elastic metal board 83 and the developer amount per unit area on a developing roller 40 according to aspects of the present invention. Specifically, FIG. 7 shows the relationship of the regulation angle θ2 relative to the developer amount per unit area (M/A, mg/cm2) formed on the developing roller 40 after the tangential part of the elastic metal board 83 passes over the surface of the developing roller 40. Here, the deformation δ of the elastic metal board 83 is 1.5 to 2.0 mm, and the tangential angle θ1 lies in the range of 15° to 20°. The developing roller 40 is made of a non-magnetic conductive rubber. Also, a surface roughness (Rz) of the bent part 83*a* that faces toward a circumference of the developing roller 40 is within the range of 3 to 10 μm.

Here, the curve X represents the amount of the developer attached to the developing roller 40, and the curve Y represents the amount of the developer attached to the photosensitive body 10. As shown in these curves, as the regulation angle θ2 becomes increasingly more negative, the value of the developer amount per unit area (M/A, mg/cm2) rises. Accordingly, the developer regulating member 80 according to aspects of the present invention is desirably provided to have a negative value of the regulation angle θ2 in order to obtain a desired developer amount per unit area on the basis of the values shown on the graph.

In particular, it is desirable to keep the desired density of the developer uniform by designing the free length (L) considering the density of the developer according to the draw rate of the elastic metal board 83, and providing the regulation angle θ2 to have a negative value.

The image forming process of the image forming apparatus having the developing cartridge 1 according to aspects of the present invention with this configuration will be described by referring to FIGS. 2 and 3. Hereinafter, the components that are the same as those in the related art will be referred to with the same reference numeral as in FIG. 1.

First, when an output signal is applied, the electrifying roller 20 electrifies (or charges) the photosensitive body 10 to a predetermined potential by contacting with the photosensitive body 10. At this time, the light scanning unit 130 scans a beam on the surface of the electrified photosensitive body 10 to form an electrostatic latent image that corresponds to the image data received from a host apparatus (not shown).

The supplying roller 50 is supplied with a developer from the developer storing part 60 to supply the developer to the developing roller 40. The developer regulating member 80 generates a tangential line pressure on the surface of the developing roller 40 to regulate the amount of the developer that is attached (or adhered) to the surface of the developing roller 40. Here, the elastic metal board 83 having a shorter free length as the draw rate increases, is coupled to the supporting member 81 and regulates the density of the developer by the surface texture generated by the bend of the bent part 83*a*. Also, the elastic metal board 83 is provided to have a negative regulation angle θ2. The negative regulation angle θ2 regulates the density of developer attached to the developing roller 40 to be uniform.

The developing roller 40, having the developer density regulated by the developer regulating member 80, selectively spreads the developer on the electrostatic latent image on the photosensitive body 10. Then, the transferring roller 30 applies a suitable transferring voltage to transfer the developer from the surface of the photosensitive body 10 to the printable medium.

The outputted printable medium, using the above described process, maintains the optimum printing density through the use of the developer regulating member 80.

As described above, the developing cartridge and the image forming apparatus having the same according to aspects of the present invention couples the elastic metal board to the supporting member to have a free length capable of optimizing the output density of the developer according to the material characteristics of the elastic metal board making up the developer regulating member, to thereby improve the output quality.

Also, the regulation angle θ2 of the developer regulating member is provided to have a negative value, to thereby efficiently increase or regulate the amount of developer that attaches or adheres to the developing roller.

As described above, the developing cartridge and the image forming apparatus having the same according to aspects of the present invention is provided with a developer regulating member having a free length corresponding to the desired output density, to thereby keep the output quality uniform.

Although a few aspects of the present invention have been shown and described, it will be appreciated by those skilled in the art that changes may be made in the aspects without departing from the principles and spirit of the invention, the scope of which is defined in the claims and their equivalents.

What is claimed is:

1. An image forming apparatus, comprising:

a main body of a toner cartridge, a photosensitive body to spread a developer on a printable medium, a developing roller to supply the photosensitive body with the developer, a developer regulating member to regulate an amount of the developer supplied to the photosensitive body by the developing roller, the developer regulating member comprising a supporting member coupled to the main body and an elastic metal board having a bent part extended from the supporting member and contacting the developing roller, and a free length of the elastic metal board that was provided shorter as a draw rate of an elastic metal board material was increased.

2. The image forming apparatus according to claim 1, wherein the elastic metal board comprises a free end part at the bent part, and a deflection angle made by a deflection of the free end part with respect to the supporting member is larger than a tangential angle between a tangent of the elastic metal board in contact with the developing roller and the supporting member.

3. The image forming apparatus according to claim 2, wherein the elastic metal board comprises one of beryllium bronze, stainless steel, and phosphor bronze.

4. The image forming apparatus according to claim 1, wherein the elastic metal board comprises one of beryllium bronze, stainless steel, and phosphor bronze.

5. The image forming apparatus according to claim 1, wherein the developing roller comprises a non-magnetic rubber having a hardness value in a range of 50 to 80 according to a JIS A scale.

6. A developing cartridge, comprising:

a main body, a photosensitive body to spread a developer on a printable medium, a developing roller to supply the photosensitive body with the developer, and a developer regulating member to uniformly regulate an amount of the developer supplied to the photosensitive body by the developing roller, the developer regulating member comprising a supporting member coupled to the main body and an elastic metal board having a bent part extended from the supporting member and contacting the developing roller, and a free length of the elastic metal board that was provided shorter as a draw rate of an elastic metal board material was increased.

7. The developing cartridge according to claim 6, wherein the elastic metal board comprises a free end part at the bent part, and a deflection angle made by a deflection of the free end part with respect to the supporting member is larger than a tangential angle between a tangent of the elastic metal board in contact with the developing roller and the supporting member.

8. The developing cartridge according to claim 7, wherein the elastic metal board comprises one of beryllium bronze, stainless steel, and phosphor bronze.

9. The developing cartridge according to claim 7, wherein the deflection of the free end is between a range of about 1.5 mm to 2.0 mm, and the tangential angle is between a range of about 15° to 20°.

10. The developing cartridge according to claim 7, wherein the difference between the tangential angle and the deflection angle is a negative number.

11. The developing cartridge according to claim 10, wherein a density of a developer increases as the negative number increases.

12. The developing cartridge according to claim 6, wherein the elastic metal board comprises one of beryllium bronze, stainless steel, and phosphor bronze.

13. The developing cartridge according to claim 6, wherein the developing roller comprises a non-magnetic rubber having a hardness value in a range of 50 to 80 according to a JIS A scale.

14. The developing cartridge according to claim 6, wherein the free length is the length between the bent part and a portion of the elastic metal board coupled to the supporting member.

15. The developing cartridge according to claim 6, wherein the draw rate is between a range of about 13.5% to about 14.5%, and a desired length is between a range of about 11.7 mm to about 11.9 mm.

16. A developing cartridge, comprising:

a developing roller; and a developing regulating member comprising a support member and a thin panel, the support member being fixed to the developing cartridge and the thin panel having a free length between a first end and a second end thereof, wherein the second end is attached to the support member and the first end tangentially touches the developing roller, and a density of a developer adhering to the developing roller is controlled by adjusting a draw rate and the corresponding free length of the thin panel.

17. The developing cartridge according to claim 16, wherein the thin panel is metal.

18. The developing cartridge according to claim 17, wherein the thin panel comprises one of beryllium bronze, stainless steel, and phosphor bronze.

19. The developing cartridge according to claim 16, wherein the free length is adjusted shorter as the draw rate increases.

20. The developing cartridge according to claim 16, wherein the first end is deflected due to the developing roller, and the first end tangentially touches the developing roller with a tangential line pressure f (gf/cm) of, $$f = \frac{\delta E t^2}{4L^3},$$

where E is an elastic coefficient of the thin panel, t is a thickness of the thin panel, and L is a length of the thin panel, and δ is a deflection between an original position of the first end without the developing roller and a final deflected position of the first end.

21. The developing cartridge according to claim 16, wherein a deflection angle θ3 made by a deflection of the first end with respect to the support member is larger than a tangential angle between a tangent of the first end in contact with the developing roller and the support member.

22. The developing cartridge according to claim 21, wherein deflection angle θ3 is $$\theta 3 = \frac{3\delta}{2L} \times \frac{180}{\pi}.$$

where L is a length of the thin panel and δ is a deflection between an original position of the first end without the developing roller and a final deflected position of the first end.

23. A developing cartridge, comprising:

a developing roller; and a developing regulating member comprising a support member and an elastic metal board that extends from the support member, wherein a length of an extending part of the elastic metal board has been adjusted according to one or more material characteristics of the elastic metal board to adjust a density of the developer adhering to the developing roller.

24. The developing cartridge according to claim 23, wherein the one or more material characteristics includes at least one of stress, density, draw rate, thermal expansion rate, elastic coefficient, surface roughness, hardness, strength, and tensile strength.

25. The developing cartridge according to claim 23, wherein the elastic metal board comprises one of beryllium bronze, stainless steel, and phosphor bronze.

* * * * *

UNITED STATES PATENT AND TRADEMARK OFFICE

CERTIFICATE OF CORRECTION

PATENT NO. : 7,697,872 B2
APPLICATION NO. : 11/701443
DATED : April 13, 2010
INVENTOR(S) : Hyung-jin Kim It is certified that error appears in the above-identified patent and that said Letters Patent is hereby corrected as shown below:

Column 11, Lines 11-12 Claim 22, after " $\theta 3 = \frac{3\delta}{2L} \times \frac{180}{\pi}$ "

change "." to --,--.

Signed and Sealed this

Thirteenth Day of July, 2010

David J. Kappos

David J. Kappos
*Director of the United States Patent and Trademark Office*